United States Patent [19]

Yoo et al.

[11] 3,970,545

[45] July 20, 1976

[54] HYDROCARBON DESULFURIZATION UTILIZING A NON-CATALYTIC HYDROGEN DONOR STEP AND AN OXIDATION STEP

[75] Inventors: Jin S. Yoo; Andrew P. Voss, both of South Holland, Ill.

[73] Assignee: Atlantic Richfield Company, Philadelphia, Pa.

[22] Filed: Mar. 19, 1975

[21] Appl. No.: 559,891

Related U.S. Application Data

[63] Continuation-in-part of Ser. No. 305,595, Nov. 10, 1972, abandoned.

[52] U.S. Cl. ..... 208/212; 208/214

[51] Int. Cl.[2] ..... C10G 23/02; C10G 27/04

[58] Field of Search..... 208/196, 212, 214, 208 R, 208/145

[56] References Cited

UNITED STATES PATENTS

| | | | |
|---|---|---|---|
| 2,253,308 | 8/1941 | Rosen | 208/214 |
| 2,697,682 | 12/1954 | Porter | 208/214 |
| 2,834,717 | 5/1958 | Shiah | 208/214 |
| 3,284,342 | 11/1966 | Nathan et al. | 208/208 R |
| 3,341,448 | 9/1967 | Ford et al. | 208/208 R |
| 3,565,793 | 2/1971 | Herbstman et al. | 208/208 R |
| 3,595,778 | 7/1971 | Smetana et al. | 208/208 R |
| 3,719,589 | 3/1973 | Herbstman et al. | 208/208 R |
| 3,816,301 | 6/1974 | Sorgenti | 208/208 R |

FOREIGN PATENTS OR APPLICATIONS

| | | | |
|---|---|---|---|
| 482,796 | 4/1952 | Canada | 208/214 |

*Primary Examiner*—Delbert E. Gantz
*Assistant Examiner*—G. J. Crasanakis
*Attorney, Agent, or Firm*—Frank J. Uxa

[57] ABSTRACT

A process for reducing the sulfur content of hydrocarbon material by contacting, e.g., heating, the sulfur-containing hydrocarbon material with at least one hydrocarbon hydrogen donor component capable of transferring hydrogen under conditions such that hydrogen transfer from said component to the sulfur-containing hydrocarbon material occurs to form hydrogen sulfide, oxidizing at least a portion of the remaining sulfur impurities contained in the hydrocarbon material and recovering a hydrocarbon material of reduced sulfur content.

16 Claims, No Drawings

HYDROCARBON DESULFURIZATION UTILIZING A NON-CATALYTIC HYDROGEN DONOR STEP AND AN OXIDATION STEP

This application is a continuation-in-part of application Ser. No. 305,595, filed Nov. 10, 1972, now abandoned.

The present invention relates to an improved process for reducing the sulfur content of hydrocarbon materials. More particularly, the invention relates to processing a sulfur-containing hydrocarbon material to produce a material which can be processed to yield a hydrocarbon material having reduced sulfur content.

Petroleum crude oils and topped or reduced crude oils, as well as other heavy petroleum fractions and/or distillates including vacuum tower bottoms, atmospheric tower bottoms, black oils, heavy cycle stocks, visbreaker product effluent and the like, are normally contaminated by excessive concentrations of sulfur. This sulfur may be present in heteroatomic compounds which have proven difficult to remove by conventional processing. The sulfur compounds are objectionable, for example, because combustion of fuels containing these impurities results in the release of sulfur oxides which are noxious, corrosive and, therefore, present a serious problem with respect to pollution of the atmosphere. It would be advantageous to provide hydrocarbon materials having reduced sulfur content.

Therefore, one of the primary objects of the present invention is to provide an improved desulfurization process.

An additional object of the present invention is to provide a desulfurization process for producing improved yields of useful liquid products having reduced sulfur content.

Another object of the present invention is to provide a process for the improved desulfurization of sulfur-containing hydrocarbon materials. Other objects and advantages will become apparent hereinafter.

A desulfurization process has now been discovered which comprises:

1. contacting, e.g., heating, a sulfur-containing hydrocarbon material with at least one liquid hydrocarbon component capable of transferring hydrogen to the sulfur-containing hydrocarbon material under conditions such that hydrogen is transferred from at least a portion of said component to the sulfur containng hydrocarbon material to form hydrogen sulfide, thus reducing the amount of sulfur contained in, i.e., chemically bonded to, said hydrocarbon material;
2. oxidizing at least a portion of the remaining sulfur contained in the contacted hydrocarbon material;
3, treating said oxidized sulfur-containing hydrocarbon material to remove at least a portion of the sulfur contained therein; and
4. recovering a hydrocarbon material having reduced sulfur content.

The liquid hydrocarbon component used in step (1) of the above process and at least a portion of the hydrogen sulfide formed therein may be separated from the hydrocarbon material before or after the oxidation, or before or after the treating step. Thus, this liquid hydrocarbon component may be subjected to oxidation and/or treating conditions.

This invention involves the processing of various sulfur-containing hydrocarbon materials, such as those derived from petroleum sources. In general, the sulfur content of these materials may be greater than about 1% by weight. In many instances these hydrocarbon materials contain a significant amount of thiophene sulfur which is known to be difficult to remove. Typical examples of hydrocarbon materials which are suited to the present process include heavy hydrocarbon materials such as petroleum fractions containing at least a major amount of material boiling above about 550°F., for example, crude oil, crude oil fractions and atmospheric and vacuum residues which contain about 1% by weight or more of sulfur. Additional examples of suitable hydrocarbon materials include cracked gas oils, residual fuel oils, topped or reduced crudes, crude petroleum from which the lighter fractions are absent, residues from cracking processes and sulfur-containing hydrocarbon materials from tar sands, oil shale and coal. The invention is particularly suited to those sulfur-containing heavy hydrocarbon materials which cannot be deeply flashed without extensive carry over of sulfur-containing compounds. Typical examples of the 2,3,4, and 5-ring thiophene-containing materials found in heavy hydrocarbon materials which are difficult to remove include benzothiophene, dibenzothiophene, 5-thia-3,4-benzofluorene, tetraphenyl-thiophene, diacenaphtho (1,2-b,1′,2′-d) thiophene and anthra (2,1,9-cde) thianaphthene. The hydrocarbon material may also contain non-thiophene sulfur, various sulfides, thiols, and elemental sulfur which can be removed by the process of the present invention.

The sulfur-containing hydrocarbon material is contacted with at least one liquid hydrocarbon component, i.e., hydrocarbon hydrogen donor, capable of transferring hydrogen to the hydrocarbon material. The ratio of sulfur-containing hydrocarbon material to hydrogen donor may vary over a broad range. For example, for 100 parts of hydrocarbon material from about 5 parts to about 2000 parts of hydrogen donor material may be used. However, in order to obtain the maximum benefits of the present invention, it is preferred to use from about 50 parts to about 1000 parts hydrogen donor material for 100 parts of sulfur-containing hydrocarbon material.

The above-noted contacting takes place at conditions such that hydrogen is transferred from at least a portion of the hydrocarbon hydrogen donor material to the sulfur-containing hydrocarbon material to form hydrogen sulfide. Such contacting or heating does not require the presence of a catalyst. While carrying on this contactng, e.g., heating, step, it is preferred to maintain a sufficient pressure in the contacting zone so as to maintain a major portion, preferably at least about 80% by weight, of the hydrocarbon hydrogen donor material in the liquid phase. Typical contacting pressures may be within the range from about atmospheric pressure to about 2000 psig., preferably from about 300 psig. to about 1000 psig. Contacting time may range from about 10 minutes to about 8 hours, preferably from about 30 minutes to about 2 hours. Suitable contacting temperatures may range, for example, from about 500°F. to about 1350°F. preferably from about 650°F. to about 1000°F.

The hydrocarbon hydrogen donor may be any essentially hydrocarbon component or mixture of components which is capable of transferring hydrogen to the sulfur-containing hydrocarbon material at the condition of the contacting step described above. Included among the suitable hydrogen donor are mixed naphthenic-aromatic condensed ring compounds having up to about 40 carbon atoms, per molecule, such as indane, $C_{10}$ to $C_{12}$ tetralins, decalin, di-, tetra-, and octahydroanthracene, $C_{12}$ and $C_{13}$ acenaphthenes, tetrahydroacenaphthene, as well as partially hydrogenated condensed aromatic ring compounds such as anthracene, chrysene, benzopyrene, fluorenthene, phenanthrene, pyrene and triphenylene, benzoanthracene, benzophenanthrene and the like; aromatic compounds containing from about 9 to about 26 carbon atoms per molecule and havng at least one alkyl substituent containing from about 3 to about 20 carbon atoms, such as cumene, di-isopropyl benzene, butyl benzene, octyl benzene, decyl benzene and the like; cycloparaffins containing from about 3 to about 15 carbon atoms per molecule and alkyl derivatives of said cycloparaffins containing at least one alkyl group having from 1 to about 15 carbon atoms such as cyclohexane, cyclopentane, cyclooctane, methyl cyclohexane, diethyl cyclohexane, methyl cyclododecane, tertiary butyl cyclohexane and the like. Mixtures of more than one of these components may be used as the hydrocarbon hydrogen donor. In addition, mixtures of components, e.g., petroleum refinery streams such as hydrotreated cycle or clarified oil and the like, which contain a significant amount of hydrogen donor components may be employed in the above-described contacting step.

Because of economic considerations, availability and processing efficiency, the preferred hydrocarbon hydrogen donors for use in the present invention include indane, $C_{10}$ to $C_{12}$ tetralins, decalin, di-, tetra-, and octa-hydroanthracene, $C_{12}$ and $C_{13}$ acenaphthenes, tetrahydroacenaphthene, partially hydrogenated anthracene, partially hydrogenated phenanthrene, partially hydrogenated pyrene and mixtures thereof. More preferred hydrocarbon hydrogen donors include the above-noted partially hydrogenated condensed aromatic ring compounds, especially the above-noted tetralins.

The process step whereby the sulfur-containing hydrocarbon material is contacted with at least one liquid hydrocarbon component capable of transferring hydrogen may be carried out in any conventional manner, e.g., batchwise semi-batchwise or continuously. Conventional equipment, such as stirred tanks, agitated or stirred autoclaves, heat exchangers, fired heaters and the like, may be used to perform this contacting step.

One beneficial modification of the present invention involves the hydrogenation of the dehydrogenated hydrocarbon hydrogen donor followed by recycle back to the above-described contacting step.

This hydrogenation operation may be performed using conventional procedures. The hydrogenation is normally performed in the presence of a catalyst and may take place in either the liquid, vapor or combined liquid-vapor phases. Typical hydrogenation catalysts for use in this invention include catalysts comprising a minor amount of at least one Group IV to Group VIII metal, present as elemental metal, as a metal salt, for example, oxide, sulfide and the like, or as mixtures thereof, supported on a catalyst carrier such as silica, silica-alumina, alumina, activated clays, carbon and the like. The hydrogenation operation may be either batch, semi-batch or continuous, with continuous being preferred. Reaction temperatures within the range from about 50°C. to about 400°C. are suitable while pressures ranging from about 0 psig. to about 1000 psig. or more may be used. Hydrogen to at least partially dehydrogenated hydrogen donor mole ratios may range from less than about 1 to about 10 or more. Weight hourly space velocities ranging from about 0.1 to about 100 may be used. The hydrogenation conditions may vary over a broad range depending upon the extent of hydrogenation desired, the particular material being hydrogenated, the catalyst being used and the like reaction parameters.

At least a portion of the remaining sulfur-contained in, i.e., chemically bonded to, the hydrocarbon material from the contacting or heating step, i.e., the contacted or heated hydrocarbon material, may be oxidized using any conventional oxidant which is able to chemically oxidize at least a portion of the remaining sulfur contained in this hydrocarbon material. It is preferred that the oxidant preferentially oxidize the sulfur rather than the hydrocarbon portion of the contacted or heated hydrocarbon material. By this is meant that the oxidation preferably occurs without substantial oxidation of carbon atoms to form, for example, ketones, carboxyl acids or other carbonyl-containing compounds. Included among the oxidants which may be used for such oxidation are oxygen (often in the form of oxygen-containing gases, e.g., air) ozone, hydrogen peroxide, organic peroxides, organic hydroperoxides and organic peracids, as well as inorganic peroxy compounds such as inorganic peroxides and the like. The oxidation preferably takes place in the presence of a metal-containing catalyst, described hereinafter.

Thus, the oxidation step is carried out by treating at least a portion of the sulfur-containing hydrocarbon material from the contacting step with an oxidant optionally in the presence of a metal-containing catalyst for a time sufficient to effect oxidation of at least a portion of the sulfur contained in this hydrocarbon material. The concentration of oxidant is usually dependent upon the percent sulfur contained in the contacted hydrocarbon material and, in general, the mole ratio of oxidant to sulfur contained in the hydrocarbon material is from about 0.5 to about 10 atoms of active (i.e., reducable) oxygen per atom of sulfur in the hydrocarbon material, preferably from about 1 to about 8 atoms of active oxygen per atom of sulfur and more preferably from about 1.5 atoms to about 4.0 atoms of active oxygen per atom of sulfur. Oxidants useful in the present invention include those having one, two or more atoms of active oxygen per molecule of oxidant.

The temperature utilized in carrying out the oxidation step can vary over a wide range. Preferably, a temperature within the range from about 20°F. to about 450°F. may be employed, although higher and lower temperatures can be utilized. In general, the sulfur-containing contacted hydrocarbon material is heated with the oxidant for a time sufficient to oxidize at least a portion of the contained sulfur, preferably for a time within the range of from about 5 minutes to about 24 hours and more preferably from about one-half hour to about 20 hours. The time that is utilized, in general, depends upon the percent sulfur contained in the contacted hydrocarbon material, the type of sulfur present, the type and amount of oxidant and reaction temperature. The sulfur-oxidizing step of this invention, in general, may be carried out over a broad range of pressures, preferably at a pressure in the range from about 1 atmosphere to about 100 atmospheres or more.

The preferred oxidants oxidants which are utilized in carrying out the oxidation step of the process of this invention are organic peroxides, organic hydroperoxides, organic peracids and hydrogen peroxide. These oxidants are particularly preferred since such oxidants have been found to give excellent disulfurization when combined with the contacting, sulfur reducing and recovery steps described herein. In addition, the use of the preferred oxidants have been found to be selective for oxidation of the sulfur, that is, substantial amounts of oxidation products such as acids and ketones are not formed. In addition, high product yields in the oxidation step, both as to the high product yield of oxidized sulfur impurities and the high product yield of hydrocarbon material which remains after the oxidation step and, in particular after the sulfur reducing step, are obtained utilizing the preferred oxidants. The organic oxidants include by way of example, hydrocarbon peroxides, hydrocarbon hydroperoxides and hydrocarbon peracids wherein the hydrocarbon radicals in general contain from about 1 to about 30 carbon atoms per active oxygen atom. With respect to the hydrocarbon peroxides and hydrocarbon hydroperoxides, it is particularly preferred that such hydrocarbon radical contain from about 4 to about 18 carbon atoms per active oxygen atom, i.e., per peroxide linkage, and more particularly from 4 to 16 carbon atoms per peroxide linkage. With respect to the hydrocarbon peracids, the hydrocarbon radical is defined as that radical which is attached to the carbonyl carbon and it is preferred that such hydrocarbon radical contain from 1 to about 12 carbon atoms, more preferably from 1 to about 8 carbon atoms, per active oxygen atom. It is intended that the term organic peracid include, by way of definition, performic acid.

In addition, it is contemplated within the scope of this invention that the organic oxidants can be prepared in situ, that is, the peroxide, hydroperoxide or peracid can be generated in the sulfur-containing contacted hydrocarbon material and such organic oxidant is contemplated for use within the scope of this invention.

Typical examples of hydrocarbon radicals are alkyl such as methyl, ethyl, butyl, t-butyl, pentyl, n-octyl and those aliphatic radicals which represent the hydrocarbon portion of a middle distillate or kerosene, and the like; cycloalkyl radicals such as cyclopentyl and the like; alkylated cycloalkyl radicals such as mono- and polymethylcyclopentyl radicals and the like; cycloalkyl substituted alkyl radicals such as cyclopenyl methyl and ethyl and the like; aryl and alkyl phenyl substituted alkyl radicals such as benzyl, methylbenzyl, caprylbenzyl, phenylethyl, phenylpropyl, naphthylmethyl, naphthylethyl, and the like; aryl radicals such as xylyl, methyl phenyl, ethyl phenyl and the like.

Typical examples of oxidants are hydroxyheptyl peroxide, cyclohexanone peroxide, t-butyl peracetate, di-t-butyl diperphthalate, t-butyl-perbenzoate, methyl ethyl ketone peroxide, dicumyl peroxide, t-butyl hydroperoxide, di-t-butyl peroxide, p-menthane hydroperoxide, pinane hydroperoxide, 2,5-dimethylhexane-2,5-dihydroperoxide, tetrahydronaphthalene hydroperoxide and cumene hydroperoxide as well as organic peracids, such as performic acid, peracetic acid, trichloroperacetic acid, perbenzoic acid and perphthalic acid. The preferred oxidant for use in the present invention is tertiary butyl hydroperoxide.

The catalyst which may be utilized to promote the oxidation of sulfur contained in the contacted hydrocarbon material using the preferred oxidants are catalysts selected from Group IV-B, Group V-B and Group VI-B metals. These catalysts can be incorporated into the present process by any means known to those skilled in the art, and can be included in either a homogeneous or heterogeneous catalyst system. When a homogeneous metal-containing oxidation catalyst is employed, it is preferred that the catalyst metal concentration be in the range from about 5 ppm. to about 10%, more preferably from about 10 ppm. to about 500 ppm. by weight based on the weight of the sulfur-containing contacted hydrocarbon materials. In any event, the catalyst metal concentration is such as to promote the preferential oxidation of sulfur in the sulfur-containing contacted hydrocarbon material. The catalyst can be incorporated by a variety of means and by the use of a variety of carriers. The particular catalyst carrier which is utilized is not critical with respect to the practice of this invention and can be, for example, a support medium or an anion (including complex formation) which is attached to the metal (e.g., a ligand). The preferred catalyst metals are titanium, zirconium, vanadium, tantalum, chromium, molybdenum, tungsten and mixtures thereof, with molybdenum being the more preferred catalyst metal. Illustrative ligands include halides, organic acids, alcoholates, mercaptides, sulfonates and phenolates. These metals may be also bound by a variety of complexing agents including acetonylacetonates, amines, ammonia, carbon monoxide and olefins, among others. The metals may also be introduced in the form of organometallics including "ferrocene" type structures. The various ligands illustrated above which are utilized solely as carriers to incorporate the metal into the process system, in general, have an organic radical attached to a functional group such as the oxygen atom of the carbonyloxy group of the acid, the oxygen of the alcohol, the sulfur of the mercaptan, the

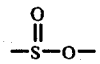

of the sulfonate, the oxygen of the phenolic compound and the nitrogen of the amines. The organic radical attached to the afore described functional groups can be defined as a hydrocarbon radical and, in general, can contain from 1 to about 30 carbon atoms. Typical examples of hydrocarbon radicals are set forth above.

Various covalent peroxide complexes, with or without ligands of suitable metals are also effective oxidation catalysts. The preferred ligands are hexamethyl phosphoamide, octamethyl phosphoamide, trialkyl-, triaryl,- and triaralkylphosphines and phosphine oxides, pyridine oxide, pyridine, 2,2'-bipyridine, dimethylforamide, dimethylacetamide, and tetramethylurea.

The metals contained in either the homogeneous or heterogeneous catalyst useful in the present invention can include an individual metal or combination of metals. These metals can be supported on a suitable material, for example, natural or synthetic alumina, silica (or combinations of both) as well as activated clays or carbon, among others, The modes of contacting the hydrocarbon material with a heterogeneous catalyst whereby the catalytic effect may be achieved may include slurry-bed reactions or continuous contacting over a stationary phase in a trickle-tube reactor or other conventional methods.

A particularly preferred catalyst for carrying out the oxidation step of the process of this invention is a molybdenum-containing catalyst prepared by a method which comprises interacting molybdenum metal with a compound selected from the group consisting of organic peroxide, organic hydroperoxide, organic peracid, hydrogen peroxide and mixtures thereof in the presence of at least one saturated alcohol having from one to four carbon atoms per molecule to solubilize at least a portion of the molybdenum metal. It is believed that the molybdenum metal interacts with the peroxy compound to form a soluble molybdenum-containing product.

Typical peroxides, hydroperoxides, and peracids useful in the preparation of the preferred molybdenum-containing catalyst have been described previously as oxidants and, therefore, no further exemplification is required. These peroxy compounds may also be substituted with groups such as halides, $-NH_2$, $-SH$, $$-\underset{|}{C}=O$$

and the like which do not interfere with the catalyst forming process. The most preferred peroxy compound for use in preparing this molybdenum-containing catalyst is tertiary butyl hydroperoxide.

Hydrogen peroxide suitable for preparing the preferred molybdenum-containing catalyst is preferably used in the form of an aqueous solution containing, for example, from about 10 to about 60 percent, preferably about 30 percent, by weight of hydrogen peroxide.

Typical examples of low molecular weight monohydroxy alcohols which are suitable for use in the preparation of the preferred molybdenum-containing catalyst include methyl alcohol, ethyl alcohol, isopropyl alcohol, n-butyl alcohol and tertiary butyl alcohol. The low molecular weight polyhydroxy alcohols which are suitable include ethylene glycol, propylene glycol, 1,2-butylene glycol and glycerol. In general, either mono- or poly-hydroxy alcohols containing from 1 to 4 carbon atoms per molecule are suitable. In the present invention, it is preferred that the molybdenum metal be interacted with tertiary butyl hydroperoxide in the presence of tertiary butyl alcohol. If tertiary butyl alcohol is used as the saturated alcohol, it is preferred, to enhance molybdenum solubility, that the interaction mixture comprise at least one mono- or poly-hydroxy alcohol having from 1 to about 16 carbon atoms per molecule, at least one primary hydroxy group, and present in an amount from about 1 to about 25% by weight of the total alcohol.

Typically, the peroxy compound comprises from about 5 to about 50% by weight of the total peroxy compound and alcohol used in catalyst preparation.

The molybdenum concentration in the catalyst mixture, i.e., the mixture comprising the interaction product of the metallic molybdenum and peroxy compound plus any excess peroxy compound and the low molecular weight alcohol, often may be within the range from about 15 ppm. to about 5.0 percent, preferably in the range from about 30 ppm. to about 2.0 percent, by weight of the total mixture. It may be desirable to prepare the catalyst in the presence of a solvent such as benzene, tertiary butyl alcohol, ethyl acetate and the like, in order to obtain the optimum molybdenum concentration in the final catalyst mixture. However, if this this type of dilution is desired, it is preferred that an excess of tertiary butyl alcohol be maintained in the catalyst mixture for this purpose.

The molybdenum metal useful in the preparation of the particularly preferred molybdenum-containing catalyst may be in the form of lumps, sheets, foil or powder. The powdered material, e.g., having a particle size such that it passes through a 50 mesh sieve, preferably through a 200 mesh sieve, on the Standard Screen Scale, is preferable because of its lower cost and in addition, it offers the greatest surface area per unit volume and, therefore, the fastest rate of solubilization.

The molybdenum metal-peroxy compound interacting may be carried out at a wide range of temperatures, for example, within the range from about 25°C. to about 100°C. Interacting pressures should be set to avoid extensive vaporization of the peroxy compound and alcohol. Typical interacting pressure may range from about 1 psia. to about 100 psia. In many instances, atmospheric pressure may be used. After the interacting has been carried out for a desired length of time, e.g., from about 5 minutes to about 30 hours, the reaction mass may be filtered to separate the insoluble molybdenum from the catalyst mixture which mixture is thereafter suitable for use as a catalyst for the oxidation of sulfur impurities in the contacted hydrocarbon materials.

Before subjecting the oxidized sulfur-containing hydrocarbon material to the sulfur reduction step, it is preferred to separate out the oxidant decomposition product or products, oxidation solvent, if any, and the alcohol or alcohols from the catalyst mixture. This separation can be obtained using conventional techniques, for example, simple distillation and/or stripping the hydrocarbon material during or after oxidation with a gas such as carbon dioxide or nitrogen.

In carrying out the process of this invention, a sulfur reduction step is utilized in combination with the contacting and oxidation step noted previously. A brief description of typical sulfur reduction steps is given below.

In the base treatment sulfur reducing step, the oxidized sufur-containing hydrocarbon material is contacted with a base, preferably an alkali metal hydroxide, for a time sufficient to reduce the sulfur content of the hydrocarbon material, generally from about 2 minutes to about 24 hours, preferably from about 10 minutes to about 2 hours. The reaction temperature is generally from about 300°F. to about 900°F., preferably from about 400°F. to about 750°F. In addition, pressures above atmospheric can be utilized in carrying out the base treatment. Thus, for example, pressures up to 100 atmospheres can be utilized in carrying out the base treatment. In general, it is preferred to use an alkali metal hydroxide, preferably potassium or sodium hydroxide, although the alkaline earth metal hydroxides or oxides, calcined dolomitic materials and alkalized aluminas can be utilized in carrying out the base treatment. In addition, mixtures of different bases can be utilized. In general, an aqueous or non-aqueous solution of the base or fused base at a concentration on a mole basis of generally from about 1 mole of base to 1 mole of sulfur up to about 10 moles of base per mole of sulfur is utilized.

In the thermal treatment step, sulfur reduction is accomplished by treating the oxidized sulfur at temperatures above 300°F., preferably above 500°F. and particularly in the temperature range of from about 550°F. to about 900°F. for a period sufficient to ensure that substantially all the sulfur gaseous decomposition products are removed. This period of time in general is within the range from about 30 minutes to about 10 hours, preferably in the range from about 30 minutes to about 5 hours. Under these conditions, the oxidized sulfur compounds are decomposed and the sulfur is liberated mainly as $SO_2$ although at higher temperatures in the region of 500°F. and over, increasing quantities of $H_2S$ are also liberated. The thermal decomposition step may be carried out in the presence of suitable promoting materials comprising porous solids having acidic or basic properties for example, supported or unsupported sodium oxide, calcium oxide, magnesium oxide, ferric oxide on alumina, bauxite, thoria on pumice, silica-alumina, soda-lime and acid sodium phosphate on carbon. Preferably, in the thermal decomposition step, a small quantity of an inert carrier gas, for example, nitrogen is passed through the reaction mixture to avoid local overheating and also to remove the gaseous sulfur decomposition products. The thermal treatment step may be carried out in the presence of at least one hydrocarbon component capable of transferring hydrogen to the oxidized sulfur-containing hydrocarbon material under conditions so that such transfer takes place as described in application Ser. No. 259,946 the disclosure of which is hereby incorporated by reference herein.

The catalytic hydrodesulfurization step may be carried out under relatively mild conditions in a fixed, moving, fluidized or ebullating bed of catalyst. Preferably, a fixed bed of catalyst is used under conditions such that relatively long periods elapse before regeneration becomes necessary, for example, a temperature within the range of from about 500°F. to about 900°F., preferably from about 650°F. to about 800°F., and at a pressure within the range of from about 100 psig. to about 3000 psig. or more.

A particularly preferred pressure range within which the hydrodesulfurization step provides extremely good sulfur removal while minimizing the amount of pressure and hydrogen required for the hydrodesulfurization step are pressures within the range of about 300 psig. to about 800 psig., more preferably from about 400 psig. to about 600 psig.

Following the sulfur oxidation step the oxidized sulfur-containing hydrocarbon material is sent to a sulfur removal step such as that described previously. Conventional procedures, e.g., flashing, stripping, distillation and the like may be employed to recover a hydrocarbon material having reduced sulfur content.

The following examples illustrate more clearly the process of the present invention. However, these illustrations are not to be interpreted as specific limitations on the invention.

EXAMPLES 1 AND 2

These examples illustrate the improved desulfurization of hydrocarbon materials which results from practicing the process of the present invention.

The hydrocarbon material employed was a petroleum vacuum still residuum (initial boiling point — 900°F.) having the following composition.

| | Weight %* |
|---|---|
| Carbon | 85.76 |
| Hydrogen | 11.07 |
| Sulfur | 2.94 |
| Nitrogen | 0.323 |
| Oxygen | 0.66 |
| Asphaltenes** | 3.23 |

*The proportions listed here result from a series of independent chemical analyses and, therefore, the sum of the weight percents is slightly in excess of 100.
**The asphaltene content is determined by the amount of the hydrocarbon material which is insoluble in hexane.

This hydrocarbon material was divided into two portions.

One portion of this hydrocarbon material was placed in a 300 cc. autoclave and heated to a temperature of 750°F. at a pressure of about 400 psig. for one hour. During this period of time, hydrogen gas was sent through the autoclave. At the end of this period of time, the product in the autoclave was sampled. It was determined a substantial amount of coke had been formed during the above processing.

The coke formed in the above processing was separated from the liquid product. Low boiling components were distilled from this product so that a liquid product having an initial boiling point of 650°F. was obtained. This liquid material, which had a sulfur content of 3.0% by weight, was oxidized as follows.

A soluble, i.e., homogeneous, oxidation catalyst was prepared by combining 0.74 weight percent molybdenum powder with tertiary butyl hydroperoxide in the presence of tertiary butyl alcohol and a mixture of $C_{10}$ to $C_{15}$ glycols containing from 4 to 6 hydroxyl group per molecule wherein at least one of the hydroxyl groups was primary. The weight ratio of tertiary butyl hydroperoxide to tertiary butyl alcohol to glycols was about 2.1:4:1. This combination was heated to about 60°C. with constant stirring and maintained at this temperature for about 1.5 to 2 hours until all the molybdenum was dissolved.

Tertiary butyl hydroperoxide was used as the oxidant to oxidize sulfur material in the 650°F. plus liquid material. Tertiary butyl alcohol was used as a solvent in the oxidation reaction and amounted to 30% by weight of the oxidation reaction mixture.

The oxidation reaction mixture was formed by combining the 650°F. plus hydrocarbon material, catalyst, tertiary butyl alcohol and tertiary butyl hydroperoxide with constant stirring to insure uniformity. This mixture contained 3.0 moles of tertiary butyl hydroperoxide per mole of sulfur and 50 ppm. of molybdenum.

This reaction mixture was placed in an autoclave and heated to a temperature of 240°F. and maintained at this temperature for a one hour period of time to effect sulfur oxidation. After this period of time, the liquid product in the flask was stripped free of essentially all tertiary butyl alcohol and lighter components.

The remaining liquid product was cooled and placed in an autoclave. This material was heated to a temperature of 775°F. and maintained at this temperature for one hour. Throughout this period of time, hydrogen gas at 200 psig. was sent through the autoclave. At the end of one hour, the liquid product was sampled and analyzed for sulfur content. It was determined that the above processing had produced a liquid product containing about 45.3% of the sulfur which was originally contained in the petroleum vacuum still residuum.

A second sample of the above-described petroleum vacuum still residuum was placed in a 300 cc. autoclave along with an amount of tetralin so as to form a mixture of 50% by weight of hydrocarbon material and 50% by weight of tetralin. This mixture was heated to a temperature ranging from 720°F. to 780°F. at a pressure ranging from 500 psig. to 600 psig. for one hour. As before, during this period of time, hydrogen was sent through the autoclave. The hydrogen-rich off gas from the autoclave contained a portion of the $H_2S$ formed in this heating step. At the end of this period of time, the product in the autoclave was sampled. It was determined that essentially no coke had been formed when the hydrocarbon material was processed in the presence of the liquid hydrocarbon hydrogen donor, tetralin.

The liquid product processed in the presence of tetralin was fractionated so as to form a hydrocarbon material having an initial boiling point of 650°F. The lower boiling material from this fractionation included essentially the remainder of the hydroge sulfide formed in the heating step. The 650°F. initial boiling hydrocarbon material, which contained the remaining portion of the sulfur originally contained in the residuum, was oxidized and thermally treated in the same manner as that described previously. At the end of the one hour period at 775°F. the liquid product was sampled and analyzed for sulfur content. It was determined that the above processing had produced improved yields of a liquid containing only about 30 percent of the sulfur which was originally contained in the petroleum vacuum still residuum.

These examples illustrate certain of the advantages of the present process. The use of a liquid hydrocarbon hydrogen donor material provides a liquid product having reduced sulfur content. For example, processing using this hydrogen donor material resulted in a liquid product containing only about 30 percent of the sulfur originally present whereas processing without the hydrogen donor gave a liquid product containing over 45 percent of the original sulfur. In addition, the present process reduces coke formation relative to processing without hydrogen donor material to give improved yields of liquid product. Therefore, the above examples show that the present invention gives improved yields of liquid product having reduced sulfur content.

While this invention has been described with respect to various specific examples and embodiments, it is to be understood that the invention is not limited thereto and that it can be variously practiced within the scope of the following claims.

The embodiments of the invention in which an exclusive property or privilege is claimed are defined as follows:

1. In a desulfurization process for producing a hydrocarbon product of reduced sulfur content from a sulfur-containing hydrocarbon feedstock a major portion of which boils above about 550°F., wherein a portion of said contained sulfur is preferentially oxidized and said oxidized sulfur-containing hydrocarbon feedstock is treated to remove at least a portion of the oxidized sulfur and wherein said hydrocarbon product of reduced sulfur content is recovered, the improvement which comprises heating said sulfur-containing hydrocarbon feedstock prior to the oxidation step with at least one liquid hydrocarbon compound capable of transferring hydrogen to said sulfur-containing hydrocarbon feedstock without the presence of a catalyst under conditions such that hydrogen which is transferred from at least a portion of said liquid hydrocarbon compound is reacted with said sulfur-containing hydrocarbon feedstock to form hydrogen sulfide, said heating being conducted at a ratio of 100 parts by weight of said sulfur-containing hydrocarbon feedstock to from about 5 parts to about 2000 parts by weight of said hydrocarbon compound, and said heating being conducted at a temperature in the range from about 500°F. to about 1350°F.

2. The process of claim 1 wherein said hydrocarbon compound is selected from the group consisting of mixed napthenic-aromatic condensed ring compounds having up to about 40 carbon atoms per molecule, aromatic compounds containing from about 9 to about 26 carbon atoms per mole and having at least one alkyl substituent having from about 3 to about 20 carbon atoms, cyclo-paraffins containing from about 3 to about 15 carbon atoms per molecule, alkyl derivatives of said cyclo-paraffins containing at least one alkyl group having from 1 to about 15 carbon atoms, and mixtures thereof.

3. The process of claim 2 wherein said hydrocarbon compound is selected from the group consisting of indane, $C_{10}$ to $C_{12}$ tetralins, decalin, di-, tetra-, and octahydroanthracene, $C_{12}$ and $C_{13}$ acenaphthenes, tetrahydroacenaphthene, partially hydrogenated anthracene, partially hydrogenated phenanthrene, partially hydrogenated pyrene and mixtures thereof.

4. The process of claim 3 wherein said heating is being conducted at a ratio of 100 parts of said sulfur-containing hydrocarbon feedstock to from about 100 parts to about 1000 parts by weight of said hydrocarbon compound, said heating being conducted at a temperature in the range from about 650°F. to about 1000°F. at a pressure in the range from about atmospheric pressure to about 2000 psig. and for a period of time in the range from about 10 minutes to about 8 hours.

5. The process of claim 4 wherein said compound is selected from the group consisting of $C_{10}$ to $C_{12}$ tetralins and mixtures thereof.

6. A desulfurization process for producing a hydrocarbon product of reduced sulfur content which comprises:

a. heating a sulfur-containing hydrocarbon feedstock a major portion of which boils above about 550°F., with at least one liquid hydrocarbon compound capable of transferring hydrogen to said sulfur-containing hydrocarbon feedstock without the presence of a catalyst under conditions such that hydrogen which is transferred from at least a portion of said liquid hydrocarbon compound is reacted with said sulfur-containing hydrocarbon feedstock to form hydrogen sulfide, said heating being conducted at a ratio of 100 parts by weight of said sulfur-containing hydrocarbon feedstock to from about 5 parts to about 2000 parts by weight of said hydrocarbon component is present, and said heating being conducted at a temperature in the range from about 500°F to about 1350°F.

b. oxidizing at least a portion of the remaining sulfur contained in said heated hydrocarbon feedstock;

c. treating said oxidized sulfur-containing hydrocarbon feedstock to remove at least a portion of said remaining sulfur from said oxidized sulfur-containing hydrocarbon feedstock; and d. recovering a hydrocarbon product having reduced sulfur content.

7. The process of claim 6 wherein step (2) comprises treating said heated sulfur-containing hydrocarbon feedstock with from about 0.5 atoms to about 10 atoms of active oxygen per atom of sulfur present in said feedstock to preferentially oxidize at least a portion of the sulfur contained in said hydrocarbon feedstock, said active oxygen being in the form of an oxidant selected from the group consisting of oxygen, ozone, hydrogen peroxide, organic peracids, organic hydroperoxides, organic peroxides and mixtures thereof.

8. The process of claim 7 wherein said oxidant is selected from the group consisting of organic peroxides, organic hydroperoxides, organic peracids and mixtures thereof containing from 1 to about 30 carbon atoms per active oxygen atom and said oxidizing step (b) is being conducted in the presence of a catalyst comprising a metal in an amount effective to promote the oxidation of sulfur, said metal being selected from the group consisting of Group IV-B metals, Group V-B metals, Group VI-B metals and mixtures thereof.

9. The process of claim 8 wherein said hydrocarbon compound is selected from the group consisting of mixed napthenic aromatic condensed ring compounds having up to about 40 carbon atoms per molecule, aromatic compounds containing from about 9 to about 26 carbon atoms per mole and having at least one alkyl substituent having from about 3 to about 20 carbon atoms, cyclo-paraffins containing from about 3 to about 15 carbon atoms per molecule, alkyl derivatives of said cycloparaffins containing at least one alkyl group having from 1 to about 15 carbon atoms and mixtures thereof.

10. The process of claim 8 wherein said metal is selected from the group consisting of titanium, zirconium, vanadium, tantalum, chromium, molybdenum, tungsten and mixtures thereof and is present in an amount from about 5 ppm. to about 10% by weight of said heated sulfur-containing hydrocarbon feedstock.

11. The process of claim 10 wherein said hydrocarbon compound is selected from the group consisting of indane, $C_{10}$ to $C_{12}$ tetralins, decalin, di-, tetra-, and octahydroanthracenes, $C_{12}$ and $C_{13}$ acenaphthenes, tetrahydroacenaphthene, partially hydrogenated anthracene, partially hydrogenated phenanthrene, partially hydrogenated pyrene and mixtures thereof.

12. The process of claim 11 wherein said metal is molybdenum.

13. The method of claim 12 wherein said compound is selected from the group consisting of $C_{10}$ to $C_{12}$ tetralins and mixtures thereof.

14. The process of claim 11 wherein said catalyst is prepared by a method which comprises interacting molybdenum metal with a compound selected from the group consisting of organic hydroperoxide, organic peroxide, hydrogen peroxide and mixtures thereof in the presence of at least one saturated alcohol having from one to four carbon atoms per molecule at conditions such that at least a portion of said molybdenum is solubilized.

15. The process of claim 14 wherein said heating is being conducted at a ratio 100 parts of sulfur-containing hydrocarbon feedstock to from about 50 parts to about 1000 parts by weight of said hydrocarbon compound, said heating is being conducted at a temperature in the range from about 650°F. to about 1000°F. at a pressure in the range from about atmospheric pressure to about 2000 psig. and for a period of time within the range from about 10 minutes to 8 hours, and said interacting of said molybdenum metal with said compound to form said catalyst is being conducted at a temperature in the range from about 25°C. to about 100°C.

16. The process of claim 14 wherein said catalyst is prepared by a method which comprises interacting molybdenum metal with tertiary butyl hydroperoxide in the presence of tertiary butyl alcohol and at least one mono- or poly- hydroxy alcohol having from 1 to about 16 carbon atoms per molecule, said mono- or polyhydroxy alcohol having at least one primary hydroxy group present in an amount sufficient to enhance molybdenum solubility.

* * * * *